United States Patent [19]

Pocrnja et al.

[11] 4,328,675

[45] May 11, 1982

[54] METHOD OF RECOVERING POWER IN A COUNTERPRESSURE-STEAM SYSTEM

[75] Inventors: Anton Pocrnja; Alfred Bolkart; Josef Dworschak, all of Munich, Fed. Rep. of Germany

[73] Assignee: Linde Aktiengesellschaft, Wiesbaden, Fed. Rep. of Germany

[21] Appl. No.: 84,195

[22] Filed: Oct. 12, 1979

[30] Foreign Application Priority Data

Oct. 13, 1978 [DE] Fed. Rep. of Germany ..... 2844742

[51] Int. Cl.[3] ..... F01K 13/00

[52] U.S. Cl. ..... 60/676; 60/648; 60/679

[58] Field of Search ..... 60/648, 653, 670, 676, 60/678, 679, 651, 671, 677

[56] References Cited

U.S. PATENT DOCUMENTS

| | | | |
|---|---|---|---|
| 2,643,519 | 6/1953 | Powell | 60/678 |
| 3,376,706 | 4/1968 | Angelino | 60/651 X |
| 3,391,539 | 7/1968 | Dimitroff, Jr. et al. | 60/648 X |
| 4,178,761 | 12/1979 | Schwartzman | 60/648 |
| 4,214,451 | 7/1980 | Coombes et al. | 60/648 |
| 4,249,384 | 2/1981 | Harris | 60/653 X |

*Primary Examiner*—Allen M. Ostrager
*Assistant Examiner*—Stephen F. Husar
*Attorney, Agent, or Firm*—Karl F. Ross

[57] ABSTRACT

A method of obtaining work (e.g. electrical energy) in a counterpressure steam system in which the steam is expanded to produce work, e.g. drive an electrical current generator, in which the steam, prior to the expansion, is passed into isobaric heat exchange at an elevated pressure with expanded steam and is then heated substantially isobarically by externally supplied heat. After expansion and at a relatively low pressure, the steam is substantially isobarically cooled.

3 Claims, 1 Drawing Figure

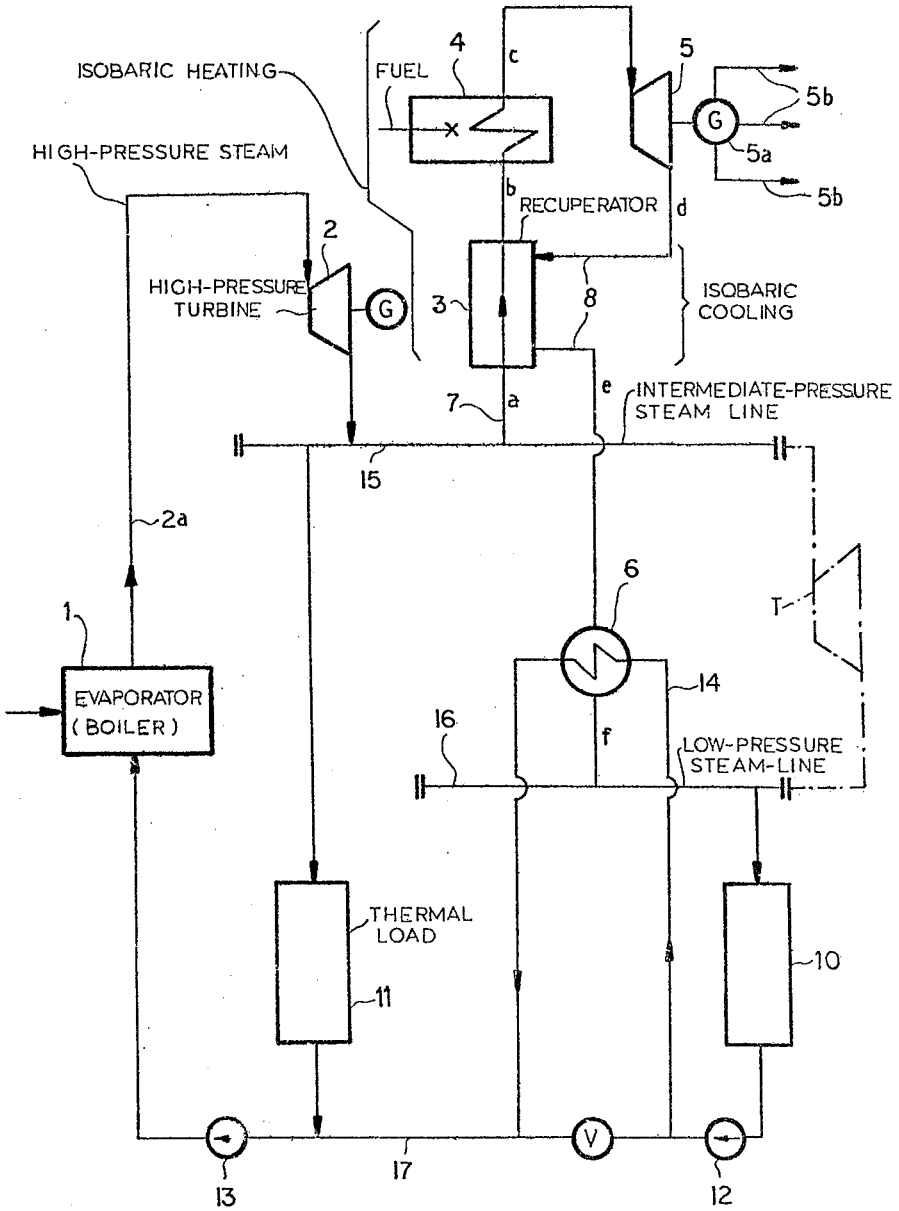
ISOBARIC HEATING
FUEL
4
c
5
5b
G
5a
5b
HIGH-PRESSURE STEAM
b
RECUPERATOR
d
2
HIGH-PRESSURE TURBINE
G
3
8
ISOBARIC COOLING
7
a
e
INTERMEDIATE-PRESSURE STEAM LINE
15
2a
6
T
1
EVAPORATOR (BOILER)
14
16
f
LOW-PRESSURE STEAM-LINE
THERMAL LOAD
11
10
V
13
17
12

METHOD OF RECOVERING POWER IN A COUNTERPRESSURE-STEAM SYSTEM

FIELD OF THE INVENTION

The present invention relates to a method of recovering work, e.g. in the form of electrical energy, in a system containing a counterpressure evaporator, hereinafter referred to as a counterpressure evaporator system and, more particularly, to the operation of a counterpressure evaporator system so as to obtain useful power by the expansion of steam (water vapor) at an elevated pressure.

BACKGROUND OF THE INVENTION

Counterpressure steam systems can be power units in which the combustion heat, i.e. the heat generated by combustion of a fuel, or the heat from some other external source, can be used to cover the power requirements and the thermal requirements of the system.

Water vapor at high pressure and high temperature is generated in a boiler and is used to drive a high-pressure turbine in which the steam is expanded to a certain temperature level and/or pressure. The conventional systems, moreover, permit steam to be recovered at the output for expansion in another turbine in a second stage and/or to cover thermal requirements of the plant. An apparatus of this type is described, for example, in *Linde Berichte aus Technik und Wissenschaft,* 38, 1976, pages 3–8 (Linde Reports of Technology and Science).

In power-intensive industries, the requirements for electrical and mechanical energy cannot always be covered by such types of apparatus. For example, this is the case in olefin and ammonia plants as described in the above-mentioned article. It is usually necessary with such systems to introduce additional electrical energy, in the form of current supplied from the exterior or outside the plant or installation, or to generate mechanical energy with other fuels to satisfy the requirements of the plant or installation. With the present high cost of energy, this need for external sources has posed a significant problem, especially since the internal plant energy is frequently not fully utilized or economically exploited.

OBJECTS OF THE INVENTION

It is the principal object of the present invention, therefore, to provide a counterpressure steam system which obviates the disadvantages of earlier systems and permits the recovery of electrical energy, particularly for plants or installations of the type described, so that the need for externally supplied energy is minimized.

It is another object of the present invention to provide a method of operating a counterpressure steam system with an increased power/heat ratio.

SUMMARY OF THE INVENTION

These objects and others which will become apparent hereinafter are attained, in accordance with the present invention, in a process in which the steam, prior to the work-producing expansion, is heated initially by heat exchange with expanded steam (recuperative heat exchange) and then with the aid of an external source of thermal energy substantially isobarically and after the expansion, e.g. in a turbine connected to an electrical generator, is isobarically cooled at the resulting lower temperature.

More specifically, the invention relates to an improvement in a system in which steam is available at a relatively high pressure level, e.g. from a first steam line, and at a relatively low pressure level, e.g. in a second steam line, in a plant or installation in which the high pressure steam is used at least in part to feed thermal loads and at least in part to drive a turbine, e.g. in a main power generator. In such a system, moreover, a portion of the steam of the high pressure line can be produced by evaporating condensate (boiling) which at a still higher pressure is fed to a further turbine and thereafter is returned to the high pressure line mentioned earlier. Thus, in a system of the type with which the present improvement is concerned, the high pressure line carries steam under an intermediate pressure.

According to the invention, therefore, the steam at this intermediate pressure is subjected to isobaric heating in two stages before it is expanded to operate a turbine transforming the steam energy into electrical energy, the low pressure steam from this turbine being used to recuperatively heating the intermediate-pressure steam in the recuperative heat exchanger, steam in the recuperative heat exchanger constituting the first of these two isobaric heating stages.

In prior systems utilizing two steam pressure lines, the steam from the higher-pressure line is expanded simply in a turbine to the pressure prevalent in the lower-pressure line and is fed to this line.

The steam used to operate the auxiliary turbine of the invention is drawn from the higher-pressure line and is initially further heated recuperatively by heating from the expanded steam and thereafter with externally supplied thermal energy, for example, in a combustion-type or fuel-fired heater isobarically and only then, usually in a plurality of stages, is expanded to produce the expanded steam from which the thermal energy is recovered in the recuperator. This expanded steam can thereafter be returned to the lower-pressure steam line at the level thereof.

This technique has been found to increase the transformation to mechanical energy and hence raise the power output/heat ratio of the plant or installation. Only a small amount of externally supplied energy, in the form of fuel, is necessary and a major part of the heat applied to the steam in the two-stage process can be transferred to it in the recuperator which not only allows an optimum utilization of the heat carrier formed by the steam but also enables an optimum utilization of the fuel to generate an externally high temperature in the steam prior to expansion.

Since the energy output of the auxiliary system increases with increasing temperature of the steam prior to expansion and the efficiency likewise increases, the highest possible temperature of the steam prior to expansion is desirable. With the system of the present invention, this temperature is limited only by the materials of the second stage heater.

A further advantage of the recuperative heating of the first stage is that the depleted steam from the turbine is already at a relatively high temperature because of the contribution of thermal energy from the second stage or fuel-fired heater. This of course results in a higher temperature at the second stage for the steam to be expanded and provides optimum temperature conditions for all phases of the auxiliary generating system.

For ideal gases and even steam with relatively small temperature differentials across the recuperative heat expansion stage, the turbine output is the mechanical energy equivalent of the externally supplied thermal energy.

The use of the externally supplied energy markedly increases the overall efficiency in terms of electrical power output by comparison with that obtainable by conventional techniques.

After the isobaric cooling, the expanded steam frequently has a relatively high heat content and, indeed, a higher heat content than the steam in the low-pressure line returning from a conventional turbine. According to the invention, condensate is circulated through a heat exchanger traversed by this partially depleted steam before it is introduced into the return or low-pressure steam line. This additional heat can be used to supply further heat loads, e.g. to heat a fluid medium of an additional power generating process or for some other purpose in conjunction with the installation or system. It is most practical, however, to recover this additional quantity of heat to preheat the feed water or the water of the counterpressure steam-generating system and thus make up in whole or in part the thermal losses in the evaporator (boiler) which customarily operates with an efficiency of only about 90% (0.9).

In an alternative embodiment of the method, operating with the same efficiency of the auxiliary generating system, the steam throughput of the counterpressure steam system can be reduced because of the recovery of the additional heat.

Finally, in yet a third aspect of the invention, the heat surplus of the expanded and substantially isobarically cooled steam can be introduced directly into the low-pressure steam line without further cooling and without other thermal-load supply.

The system of the present invention thus increases the power/heat ratio with counterpressure operation of the system by comparison with conventional processes and thereby provides a higher efficiency in the system of the instant invention. As has been described, the higher efficiency is the function of the higher temperature level of the steam before expansion in the auxiliary generating network which corresponds to a higher specific energy output, low fuel consumption etc.

When the system of the present invention utilizes condensation turbines, instead of simple expansion turbines, it is found that the cooling water demand is significantly reduced by comparison with that otherwise analogous prior art system using condensation turbines and that the quantity of steam required is less because of the higher power/heat ratio.

BRIEF DESCRIPTION OF THE DRAWING

The above and other objects, features and advantages of the present invention will become more readily apparent from the following description, reference being made to the accompanying drawing in which the sole FIGURE is a flow diagram illustrating the principles of the invention.

SPECIFIC DESCRIPTION AND EXAMPLE

In the drawing there is shown a system having an intermediate-pressure steam line 15 and a low-pressure steam line 16 which are merely representative of two steam lines in any system, e.g. one of those described in the aforementioned publication, of an industrial process or power plant. Naturally, the number of steam lines can vary, i.e. can be more than two, as long as at least two of the steam lines are at different pressures.

The steam of the counterpressure steam system is generated in an evaporator or boiler 1 and is fed through a line 2*a*, generally receiving steam at a pressure higher than that in the intermediate pressure line, to the high pressure turbine 2 in which the steam is expanded to a pressure of about $39.2 \cdot 10^5$ N/m$^2$ and at a temperature of 642° K. is fed to the intermediate-pressure line 15.

In conventional processes the steam of this line, insofar as it is not required by thermal loads 11, is expanded in a turbine T and fed directly to the low-pressure steam line as illustrated in dot-dash lines in the drawing. Naturally, such a turbine can also be provided in the system of the present invention in combination with the counterpressure arrangements illustrated in solid lines.

According to the invention, however, at least a portion of the steam equivalent to that supplied by the high pressure turbine 2 to the intermediate pressure steam line 15 is led at 7 to a recuperative heat exchanger 3, hereinafter referred to as a recuperator, in which the steam is substantially isobarically heated to a temperature of 770° K. The steam is then passed into the fuel-fired heater 4 in which its temperature is substantially isobarically raised to 993° K.

This substantially isobarically heated steam is then passed to a turbine 5 which can drive an electrical generator 5*a* whose lines 5*b* supply power to the plant or otherwise operate various electrical loads. In the turbine 5, the steam is expanded substantially to the pressure prevailing in the low-pressure steam line, for example $9.8 \cdot 10^5$ N/m$^2$. However, prior to feeding the steam to this low-pressure line, the steam is substantially isobarically cooled by passing it via lines 8 through the recuperator 3 in indirect heat exchange with the steam which is recuperatively and substantially isobarically heated.

The steam, which emerges from the turbine 5 at a temperature of about 791° K., leaves the recuperator 3 at a temperature of about 653° K. and, because it has a relatively high residual heat content by comparison to conventional systems, is used as the heat carrier for a heat exchanger 6 which serves to heat the feed water for the boiler 1. The steam emerges from the heat exchanger 6 at a temperature of about 494° K. and is supplied at this temperature to the low-pressure line 16. The feed water, e.g. condensate from a low-pressure process-steam consumer or load 10, is displaced by the pump 12 through lines 14 through the heat exchanger 6 and is returned to line 17 from which it is displaced by pump 13 to the boiler 1 at an elevated pressure. All of the turbines drive respective generators or are connected to pumps or compressors (not shown).

In the accompanying Table 1 the temperature, pressure, specific enthalpy and specific entropy of the steam at the points a–f of the drawing have been given. Table 2 provides the details of a comparative example.

With a conventional process using only a turbine T between the steam lines 15 and 16, the recovered energy is only 266 kJ per kg of steam while with the system of the present invention, 514 kJ per kg of steam is supplied in heater 4, 345 kJ per kg of steam is recovered at recuperator 3 and heat exchanger 6 so that the total added energy is 169 kJ per kg of steam. With the system of the present invention a minimum of 169 kJ of mechanical energy per kg of steam is recovered at the turbine above that of the conventional system and because of the higher operating temperatures, the efficiency is likewise increased.

TABLE 1

| Position | Temperature °K. | Pressure $10^5$ N/m$^2$ | Enthalpy i $10^6 \frac{J}{kg}$ | Entropy s $10^3 \frac{J}{kg}$ |
|---|---|---|---|---|
| a | 642 | 39.2 | 3.14 | 6.68 |
| b | 770 | 39.2 | 3.44 | 7.11 |
| c | 993 | 39.2 | 3.96 | 7.68 |
| d | 791 | 9.8 | 3.52 | 7.83 |
| e | 653 | 9.8 | 3.22 | 7.42 |
| f | 494 | 9.8 | 2.87 | 6.81 |

TABLE 2

| | Invention | Conventional |
|---|---|---|
| Fuel heat in heater (net) $q_B \frac{kJ}{kg}$ | 514 | — |
| Recovered heat in recuperator 3 or heat exchanger 6 $q_R \frac{kJ}{kg}$ | 345 | — |
| Additional heat consumption $\Lambda q = q_B - q_R$ $\frac{kJ}{kg}$ | 169 | — |
| Output of turbine $(\eta_T = 0.8) \frac{kJ}{kg}$ | 432 | 266 |
| Output (increase with invention) $\Lambda L \frac{kJ}{kg}$ | 169 | — |
| Efficiency $\eta = \frac{\Lambda L}{\Lambda q}$ | close to unity | up to 0.9 |

We claim:

1. A method of operating a counterpressure system in which steam is available in a first line at a relatively high pressure and in a second line at a relatively low pressure, said method comprising the steps of:

(a) substantially isobarically heating a quantity of steam at said relatively high pressure;

(b) expanding the substantially isobarically heated quantity of steam substantially to said relatively low pressure in a turbine and thereby performing mechanical work with the expanding steam;

(c) substantially isobarically cooling the expanded steam from step (b);

(d) feeding the said substantially isobarically cooled steam to said second line;

(e) preheating boiler feed water in indirect heat exchange with the expanded substantially isobarically cooled steam prior to feeding it to said second line; and (f) boiling the feed water and producing steam at a pressure above that in said first line and expanding the steam generated in said boiler in a high pressure turbine before feeding the steam expanded in said high pressure turbine into said first line, the substantially isobaric heating of the steam from said first line being effected in a first stage in which steam from said first line is passed in indirect recuperative line heat exchange with steam expanded in the turbine of step (b) and the steam is thereafter heated prior to its expansion in the turbine of step (b) in a combustion heater.

2. The method defined in claim 1, further comprising the step of additionally abstracting heat from the expanded substantially isobarically cooled steam in a thermal load.

3. The method defined in claim 1, further comprising the step of generating electrical power with the mechanical work in the turbine of step (b).

* * * * *